United States Patent [19]

Toki et al.

[11] Patent Number: 4,689,944

[45] Date of Patent: Sep. 1, 1987

[54] FLAT YARN AND METHOD FOR PRODUCING THE SAME

[75] Inventors: Masahisa Toki; Seiji Satoh, both of Osaka; Yoshiaki Matsui; Kunio Morihata, both of Nagoya; Toyoji Murata, Kiryu, all of Japan

[73] Assignee: Mitsubishi Rayon Company Ltd., Tokyo, Japan

[21] Appl. No.: 900,412

[22] Filed: Aug. 26, 1986

Related U.S. Application Data

[62] Division of Ser. No. 779,114, Sep. 23, 1985, Pat. No. 4,633,662.

[30] Foreign Application Priority Data

Sep. 28, 1984 [JP] Japan ..... 59-203299

[51] Int. Cl.[4] ..... D02G 1/00; D02G 1/14; D02G 7/00

[52] U.S. Cl. ..... 57/260; 57/208; 57/246; 57/259; 57/31

[58] Field of Search ..... 57/204, 205, 208, 233, 57/245, 235, 246, 248, 259, 260, 6, 7, 9, 12, 31, 32, 284, 286; 28/245, 247

[56] References Cited

U.S. PATENT DOCUMENTS

| | | | |
|---|---|---|---|
| 2,812,782 | 11/1957 | Stevens | 57/248 X |
| 3,118,806 | 1/1964 | Grantham | 57/260 X |
| 3,164,947 | 1/1965 | Gaston | 57/248 X |
| 3,164,948 | 1/1965 | Stratford | 57/31 X |
| 3,444,683 | 5/1969 | Hessenbruch | 57/31 |
| 3,548,581 | 12/1970 | Bobkowicz et al. | 57/286 |
| 3,622,429 | 11/1971 | Kippan | 57/234 X |
| 3,626,685 | 12/1971 | Constantakis | 57/31 X |
| 3,793,816 | 2/1974 | Kodama | 57/7 |
| 4,005,569 | 2/1977 | Corbiere | 57/208 X |
| 4,253,299 | 3/1981 | Borenstein | 57/208 X |

*Primary Examiner*—Donald Watkins
*Attorney, Agent, or Firm*—Oblon, Fisher, Spivak, McClelland & Maier

[57] ABSTRACT

A flat yarn wherein fibers composing a yarn are bonded to each other substantially in a side-by-side manner to form a tape-like flat body and the flat body has a plurality of gear-crimped portions across a width thereof. There may be a plurality of reverse points at which front and back surfaces of the yarn replace each other. The points are twisted in the same direction and positioned at random intervals from each other. The gear-crimped portions are arranged randomly in the lengthwise direction of the yarn. The fibers composing the yarn are bonded to each other in an intermittent manner in the lengthwise direction of the yarn. A fabric made from the flat yarn has an aesthetic appearance and soft touch as well as good crease resistance. A method of production for the same is also provided.

4 Claims, 4 Drawing Figures

FLAT YARN AND METHOD FOR PRODUCING THE SAME

This is a division of application Ser. No. 779,114 filed Sept. 23, 1985, now U.S. Pat. No. 4,633,662.

BACKGROUND OF THE INVENTION

1. Field of the Invention

The present invention relates to the production of a flat yarn suitable for clothing made of natural or synthetic fiber.

2. Description of the Related Art

In the prior art, a flat yarn is produced by extruding a molten polymer from a special spinneret having a nozzle hole with a flattened rectangular profile and subjecting the spun polymer to a predetermined treatment, or by slitting a film sheet into a plurality of tapes having a proper width and subjecting the tape to a predetermined treatment. The former method, however, has drawbacks in that a large size apparatus is required for carrying out the process and it is difficult to obtain a uniform flatness of the product. Moreover, since choice of polymer kinds and configurations of the product are limited, this method is not suitable for the current tendency toward small lot and multi-kinds production. On the other hand, in the latter case, the product tends to lack stiffness when the original film sheet is thin and, conversely, to be hard and coarse in touch when the film sheet is thick, both of which result in a paper-like feeling and are unsuitable for clothing use.

For solving the above problems of the prior art, a method is proposed in which one component of a thermoplastic textured yarn is melted by a solvent and the other components thereof are adhered to each other in a flat shape by the molten component, as shown, for example, in Japanese Unexamined patent publication (Kokai) Nos. 53-45443 and 57-56537. According to this method, it is expected that the paper-like appearance and touch would be improved by the use of the textured yarn. In fact, however, the bulkiness of the textured yarn is much decreased due to intensive stretching thereof during the flattening and adhering processes and there remains only a micron order crimp, whereby the above drawback is still unsolved.

SUMMARY OF THE INVENTION

It is a primary object of the invention to provide a flat yarn having an excellent appearance and touch and suitable for clothing use, by imparting a semi-permanent bulkiness to the resultant yarn.

It is another object of the present invention to provide a method for producing the above flat yarn.

The first object is achievable by a flat yarn according to the present invention wherein fibers composing a yarn are bonded to each other substantially in a side-by-side manner to form a flat body and the flat body has a plurality of gear-crimped portions across a width thereof.

The flat yarn may have a plurality of reverse points at which front and back surfaces of the yarn replace each other. The points are twisted in the same direction and positioned at random intervals from each other.

The gear-crimped portions are arranged randomly in the lengthwise direction of the yarn.

The fibers composing the yarn are bonded to each other in an intermittent manner in the lengthwise direction of the yarn.

The second object of the present invention is attainable by a method according to the present invention, comprising the steps of:

continuously impregnating at least one material yarn with a solvent of one of the fibers composing the material yarn;

bringing the material yarn into contact with a bar guide which aligns the fibers in a parallel state to form a flat body under a state of tension;

preheating the material yarn; and gear-crimping the material yarn while the solvent impregnated in the material yarn is wet.

The material yarn prefarably may be a pretwisted filament yarn.

The gear-crimping prefarably may be carried out in an intermittent manner at random pitches.

BRIEF DESCRIPTION OF THE DRAWINGS

Other objects and advantages of the present invention will be apparent from the following description with reference to the drawings, illustrating the preferred embodiments of the present invention, wherein.

DESCRIPTION OF THE PREFERRED EMBODIMENTS

Figure 1:
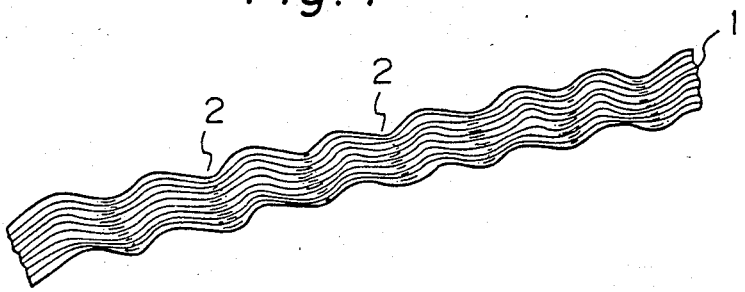
FIGS. 1 through 3 are enlarged perspective view of yarns according to the present invention; and, FIG. 4 is a diagrammatic side view of an apparatus for carrying out the method according to the present invention.

FIG. 1 shows a typical configuration of a flat yarn according to the present invention, in which filaments 1 composing the yarn are lengthwisely bonded to each other in a side-by-side manner to form a tape-like flat body. Further, the flat body is provided with a plurality of gear-crimped portions 2 along the entire length thereof.

The flat body preferably has a plain surface that is as uniform as possible. However, even if there are intersections or overlapping of the filaments, this is not a problem in practical use. A crimp configuration of the yarn imparted by the gear-crimping is not limited to a usual straight zigzag form, in which a corrugation of the crimp is perpendicular to an axis of the yarn, but may be of an inclined zigzag form, in which a corrugation thereof is slanted to the yarn axis.

The filaments are preferably bonded directly to each other without the use of a medium such as resin or adhesive. Otherwise, the bonding may be weakened by deterioration of the resin after an elapse of time. Also, bonding by heat melting is not preferable because the resultant yarn becomes hard and harsh in touch.

The filaments may be bonded partially to each other along the axial direction thereof and a pitch of the bonded portion may be optionally determined, provided that the entire configuration of the resultant yarn is not damaged. In the above partial bonding, gear-crimping is advantageously utilized, i.e., an intermeshed portion between a pair of gear-crimping rollers corresponds to the bonded portion of the resulted yarn, whereby a yarn having a soft hand and good appearance is obtained in spite of its excellent bonding structure.

Figure 2:
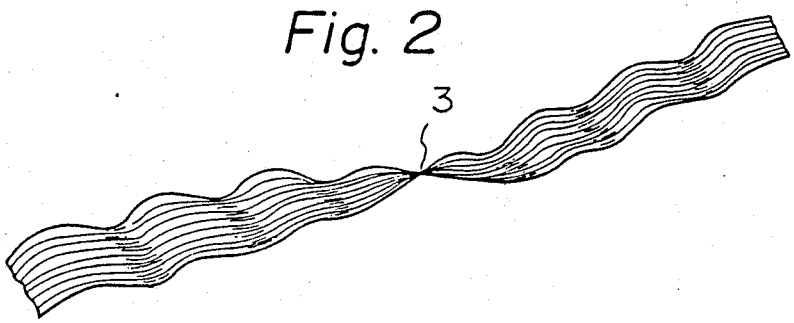

FIG. 2 illustrates a configuration of another example of the flat yarn of the present invention, in which a plurality of filaments are bonded together to form a tape-like flat body and gear-crimped along the lengthwise direction thereof in a manner similar to FIG. 1.

The sole difference between the two examples resides in that a plurality of reverse points 3 (only one is shown in the drawing) are distributed along the lengthwith direction of the yarn, at which the front and back side surfaces of the resultant yarn replace each other.

The reverse point 3 is arranged at a random pitch and twisted in the same direction as each other. The reverse point 3 is originated from a twist imparted to the material filament yarn prior to a parallel alignment step thereof, which twist is accumulated in a specified area in the yarn body during the production treatment and forms the reverse point. Thus, a number and a pitch thereof vary corresponding to an amount of the above twist and a degree of tension when it is brought into contact with a bar guide for parallel alignment thereof, as stated later in detail.

Figure 3:
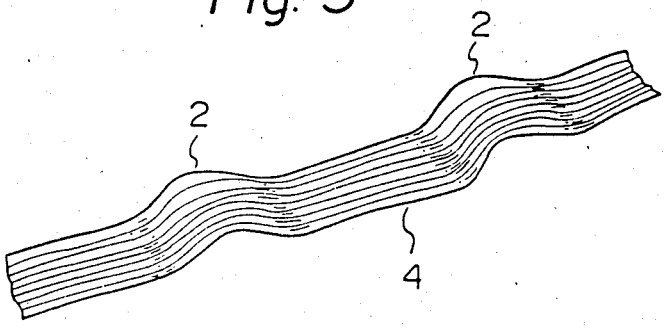

FIG. 3 illustrates a configuration of further example of the flat yarn of the present invention, in which the gear-crimped portions are randomly arranged along the lengthwise direction of the yarn, i.e., a relatively longer flat portion 4 without corrugations is interposed between the gear-crimped portion 2.

The material yarn may be a natural and/or synthetic fiber and the type thereof may be a filament yarn as stated above or a spun yarn, although the thermoplastic multifilament yarn is the most preferable from the point of view of a good luster and flexibility of the resultant yarn and excellent processibility for the gear-crimping. Such a filament yarn may be of polyacrylic, acetate, polyester, or polyamide.

Next, a process for producing the flat yarn according to the present invention will be described with reference to FIG. 4, in which a plurality of flat yarns Ya, Yb, and Yc are simultaneously produced in a parallel manner to each other from the respective material yarns Y'a, Y'b, and Y'c. The multifilament yarns Y'a, Y'b, and Y'c withdrawn from packages on a creel stand shown at the left side of the drawing are doubled together and impregnated with a solvent 5 by applicator rollers 6, 6'. In this connection, the individual yarns must be separated from each other so that they do not adhere together during the subsequent steps. The solvent is selected so as to match the fiber composing the yarn to be treated, for example, ethylene carbonate and dimethylformamide for polyacrylic fiber; acetone and methanol for acetate fiber; and ethylene glycol for polyester fiber.

Suitable amount of the solvent to be contained in the yarn may be varied in accordance with the aimed touch or hand of the resultant product. If the soft touch is required, the amount of solvent should be decreased and vice versa. For example, in case of polyacrylic fiber yarn, suitable pick up is in a range of from 50% to 150% for a solvent solution diluted in a range of from 3% to 12%.

The material yarns impregnated with the solvent 5 are passed over a bar guide 7 while in a slipping contact therewith under a state of tension, whereby the filaments composing the individual yarn are arranged in parallel to each other and, similtaneously therewith, excessive solvent imparted to the yarn is removed therefrom so that a uniform content of the solvent is attained. Therefore, the bar guide 7 must have relatively sharp edge, such the apex of a triangular sectional profile as shown in FIG. 4, over which the yarn is passed in contact therewith.

The yarns are then, dried and preheated through a series of hot rolls 8, 8' and 9, 9'. This preheating is carried out to bond the adjacent filaments to each other, to form a tape-like flat body and enhance the subsequent gear-crimping step. Though it may be carried out with a single hot roll, multi-stage heating as shown in the drawing is adantageous because it minimizes any adverse influence on the yarn quality. In this connection, the temperatures of the hot rolls are preferably become higher in a downstream direction but remain between a softening point and a gear-crimping temperature of the fiber to be treated. In this embodiment, the latter hot rolls 9, 9' are fluted in order to steadily take-up the yarn. It must be noted that this configuration of the hot rolls 9, 9' is not intended to gear-crimp the yarn, though it is analogous to that of gear-crimping rollers stated later.

The yarns are introduced into a nip between gear-crimping rollers 10 and 10' in a somewhat wet state after preheating by the series of hot rolls 8, 8' and 9, 9', in which they are pressed and crimped between intermeshing teeth of the gear-crimping rollers 10 and 10'. Finally, the yarns are introduced into a drier 11, completely dried and taken up separately from each other as a respective flat yarn.

The gear-crimping rollers may be of a generally used spur gear type. Also, they may have an intermeshing depth varying in place or may partially lack teeth corresponding to each other. According to these modified gear-crimping rollers, a flat yarn with various crimping configurations and pitches can be produced.

The drier 11 may be of any type except for hot rolls which tends to impart an excessive stretch to the yarn and decrease the crimps, so long as it is capable of providing a heating atmosphere in the operating zone.

According to the present invention, the filaments of the flat body may be partially bonded to each other in the lengthwise direction. This may be done by partial application of the solvent on the material yarn by utilizing the applicator roller 6' having a partial contacting periphery. More preferably, it is carried out in the gear-crimping step, in which the filaments of the material yarn are pressed together in the nip between the rollers along with the solvent impregnated in the yarn, by controlling the pressure between the rollers, pick up of the solvent, temperature of the rollers, and so on, whereby the obtained yarn is intermittently bonded only by the nip of the gear-crimping rollers.

Though a plurality of material yarns are processed together in the example stated above, a single yarn may be utilized.

When the material yarn is pretwisted, the twist tends to be accumulated in a portion of the yarn just before the bar guide 7 during the parallel alignment step of the filaments. When the accumulation of the twist reaches a critical amount, the material yarn is reversed to mitigate a torque caused by the twist accumulation. The aspect of this reversal varies in accordance with a degree of yarn tension and an amount of pretwist. In any case, however, it occurs randomly, whereby the flat yarn rich in variation with alternating front and back surfaces is obtained.

If the material yarn has a good elongation, a deeper intermeshing of the gear-crimping rollers is attainable so that a rigid crimp results.

In the case of using a spun yarn instead of a filament yarn, the pressure and temperature of the gear-crimping rollers should be elevated to facilitate the flattening effect of the rollers. In this connection, a low twist yarn is preferable.

The present invention will be more clearly understood by the following examples:

EXAMPLE 1

Figure 4:
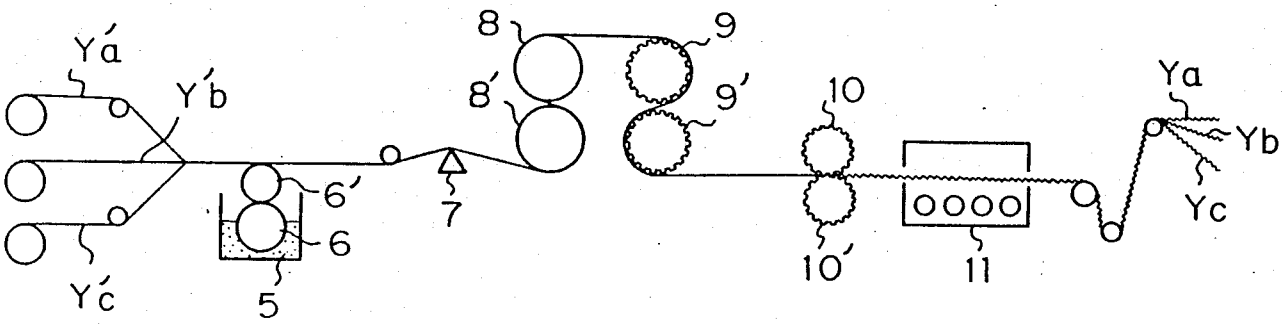

A flat yarn was produced by utilizing the arrangement shown in FIG. 4. The process conditions were as follows:

Material yarn: 10 ends of polyacrylic non-twisted filament yarn 400 d/80 fil.

Yarn supply speed: 85 m/min (overfeed rate 8%)

Solvent: ethylene carbonate 7% solution

Pick up: 80% o.w.f.

Bar Guide Profile: triangular cross section

Preheating surface temperature: flat roll 85° C. gear-toothed roll 160° C.

Gear-crimping roller: surface temperature 200° C. module 0.5 mm pitch 0.5 mm pressure 10 kg/cm$^2$ Drying temperature: 140° C. (atmosphere heated by remote infrared heater)

The flat yarn thus obtained was as shown in FIG. 1, having a width of 1 mm and a thickness of 0.1 mm.

EXAMPLE 2

Production of the flat yarn was carried out under the same conditions as Example 1 except that the material yarn was pretwisted at 30 twist/m. The resultant yarn was as shown in FIG. 2, having reverse points in the lengthwise direction thereof.

EXAMPLE 3

Production of the flat yarn was carried out under the same condition as Example 1 except that the gear-crimping roller was partially provided with a flat periphery not intermeshing with the corresponding periphery of the other roller. The resultant yarn was similar to that shown in FIG. 3.

EXAMPLE 4

Production of the flat yarn was carried out under the same conditions as Example 1 except that the surface temperature and the pressure between the gear-crimping rollers were, respectively, 190° C. and 5 kg/cm$^2$. The filaments of the resultant yarn were bonded to each other only in the gear-crimped portion and separated from each other in the remaining portion.

As stated above, in the flat yarn according to the present invention, since the fibers composing the yarn are crimped and bonded in parallel to each other in a tape form, the resultant yarn becomes bulky, which produces a fabric showing an elegant drape and soft touch, expecially when using the intermittently bonded yarn. In the case of the yarn having a plurality of reverse points in the lengthwise direction, the fabric obtained therefrom has a fantasic appearance because light reflection from the fabric surface and bulkiness vary from portion to portion thereof due to the reversed yarn surface. This effect is also attainable by the flat yarn having randomly arranged gear-crimped portions.

On the other hand, according to the method of the present invention, the fibers in the material yarn can be uniformly and readily aligned in parallel by causing the material yarn to be contact with and pass over the guide bar under of state of tension, whereby a special device for forming a flat body from the material yarn is unnecessary.

Since the fixing of a tape form of the material yarn and of the corrugation thereof are simultaneously carried out by gear-crimping the semi-wet material yarn impregnated with the solvent, the crimp structure is very rigid, which results in good maintenance of the crimp in a final fabric even after the flat yarn has been subjected to various mechanical and thermal treatments. Further, the yarn according to the present invention has different bending rigidities between the width and thickness directions due to its flat configuration. When the fabric is formed by this flat yarn, the yarn is twisted to various degrees during the knitting or weaving process and the twisted portion having different bending rigidity is uniformly distributed over the entire area of the resultant fabric, whereby wearing stress in an apparel made by the fabric can be widely dispersed. Moveover, the crease resistance of the fabric is excellent due to the multiple effect of repulsion and recovery of the rigid crimp fixed by the solvent. Finally, the aesthetic effect caused by a fancy appearance and luster variance of the yarn is also remarkable.

We claim:

1. A flat yarn wherein fibers composing a yarn are bonded to each other substantially in a side-by-side manner to form a tape-like flat body and said flat body had a plurality of gear-crimped portions across a width thereof, wherein said gear-crimped portions are arranged randomly in the lengthwise direction of said yarn.

2. A flat yarn defined by claim 1, further comprising a plurality of reverse points at which front and back surfaces of said yarn replace each other, said points being twisted in the same direction and positioned at random intervals from each other.

3. A flat yarn wherein fibers composing a yarn are bonded to each other substantially in a side-by-side manner to form a tape-like flat body and said flat body has a plurality of gear-crimped portions across a width thereof, wherein said fibers composing said yarn are bonded to each other in an intermittent manner in the lengthwise direction of said yarn.

4. A flat yarn defined by claim 3, further comprising a plurality of reverse points at which front and back surfaces of said yarn replace each other, said points being twisted in the same direction and positioned at random intervals from each other.

* * * * *